US011536060B2

(12) United States Patent
Takato

(10) Patent No.: US 11,536,060 B2
(45) Date of Patent: Dec. 27, 2022

(54) VEHICULAR DOOR STRUCTURE

(71) Applicant: Toyota Jidosha Kabushiki Kaisha, Toyota (JP)

(72) Inventor: Satoshi Takato, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 253 days.

(21) Appl. No.: 16/708,634

(22) Filed: Dec. 10, 2019

(65) Prior Publication Data

US 2020/0190871 A1 Jun. 18, 2020

(30) Foreign Application Priority Data

Dec. 12, 2018 (JP) ..... JP2018-232984

(51) Int. Cl.

| | |
|---|---|
| ***E05B 81/76*** | (2014.01) |
| ***E05B 81/16*** | (2014.01) |
| ***E05B 77/32*** | (2014.01) |
| ***E05B 77/30*** | (2014.01) |

(52) U.S. Cl.

CPC ..... *E05B 81/77* (2013.01); *E05B 77/30* (2013.01); *E05B 77/32* (2013.01); *E05B 81/16* (2013.01)

(58) Field of Classification Search

CPC ..... E05B 81/14; E05B 81/16; E05B 81/18; E05B 81/76; E05B 81/77; E05B 81/86; E05B 77/30; E05B 77/32; E05B 85/10; E05B 85/14; E05B 85/16; E05B 85/18; Y10S 292/65; Y10T 292/57; Y10T 292/0908

See application file for complete search history.

(56) References Cited

U.S. PATENT DOCUMENTS

| | | | | |
|---|---|---|---|---|
| 2002/0140237 | A1 | 10/2002 | Kobayashi et al. | |
| 2007/0069533 | A1 * | 3/2007 | Cummins | E05B 77/04 292/336.3 |
| 2015/0225987 | A1 * | 8/2015 | Frattini | E05B 85/16 292/336.3 |

FOREIGN PATENT DOCUMENTS

| | | | | |
|---|---|---|---|---|
| CN | 102725467 | A | 10/2012 | |
| JP | 2002-295096 | A | 10/2002 | |
| JP | 2014-156753 | A | 8/2014 | |
| JP | 2015-532953 | A | 11/2015 | |
| JP | 2017-166265 | A | 9/2017 | |
| WO | WO-2011061281 | A2 * | 5/2011 | E05B 85/14 |

(Continued)

OTHER PUBLICATIONS

Machine translation for WO2017129333A1 (Year: 2017).*

*Primary Examiner* — Christine M Mills
*Assistant Examiner* — Christopher F Callahan
(74) *Attorney, Agent, or Firm* — Dinsmore & Shohl LLP

(57) ABSTRACT

A vehicular door structure includes a door handle provided in a door panel that configures a part of a vehicular door, a latch mechanism provided in the vehicular door and configured to be engaged with a striker provided on a vehicle body, an unlatch portion provided in the door handle and configured to be at least partially exposed to an outside and swing with respect to the door handle, an electric unlatch operation mechanism having an actuator that is configured to disengage the latch mechanism from the striker as the unlatch portion is made to swing, and a lock sensor portion provided in a part of the unlatch portion, the part being exposed to the outside, the lock sensor portion being configured to detect a change in an electrostatic capacity.

6 Claims, 4 Drawing Sheets

(56) References Cited

FOREIGN PATENT DOCUMENTS

| | | | | | |
|---|---|---|---|---|---|
| WO | 2014/037478 | A1 | 3/2014 | | |
| WO | WO-2017009078 | A1 * | 1/2017 | ..... | E05B 81/76 |
| WO | WO-2017129333 | A1 * | 8/2017 | ..... | E05B 85/10 |

* cited by examiner

VEHICULAR DOOR STRUCTURE

CROSS-REFERENCE TO RELATED APPLICATIONS

This application claims priority to Japanese Patent Application No. 2018-232984 filed on Dec. 12, 2018, which is incorporated herein by reference in its entirety including the specification, drawings and abstract.

BACKGROUND

1. Technical Field

The disclosure relates to a vehicular door structure.

2. Description of Related Art

Japanese Unexamined Patent Application Publication No. 2014-156753 (JP 2014-156753 A) discloses an embodiment that relates to a door handle device. In this door handle device, a door handle is provided on an outer side of a vehicular door, and a lock sensor plate and an unlock sensor plate are provided inside the door handle. The lock sensor plate and the unlock sensor plate detect contact with a user based on changes in an electrostatic capacity. Once the lock sensor plate and the unlock sensor plate detect contact with the user, the vehicular door is locked or unlocked depending on a situation at the time.

Japanese Unexamined Patent Application Publication No. 2017-166265 (JP 2017-166265 A) discloses an embodiment that relates to a vehicular door handle device. The vehicular door handle device performs a latch release operation with activation of an electric actuator. Therefore, a vehicular door can be opened as a switch of the electric actuator is pressed.

SUMMARY

It is considered that the switch in the vehicular door disclosed in JP 2017-166265 A is provided in a door handle, and the electric actuator can be operated when the door handle is gripped. In this case, the unlock sensor plate and so on provided inside the door handle disclosed in JP 2014-156753 A could be arranged at a position away from a position gripped by the user. In that case, there is a possibility that detection performance of the unlock sensor plate and so on could be deteriorated. Therefore, the related arts have room for improvement in these aspects.

The disclosure provides a vehicular door structure that is able to restrain deterioration of detection performance of a sensor provided inside a door handle.

A first aspect of the disclosure is a vehicular door structure. The vehicular door structure includes a door handle provided in a door panel that configures a part of a vehicular door, a latch mechanism provided in the vehicular door, an unlatch portion provided in the door handle, an electric unlatch operation mechanism having an actuator, and a lock sensor portion provided in a part of the unlatch portion, the part being exposed to an outside. When the vehicle door is in a closed state, the latch mechanism is configured to maintain the closed state of the vehicular door by being engaged with a striker provided on a vehicle body. The unlatch portion is configured to be at least partially exposed to an outside, and swing with respect to the door handle. As the unlatch portion is made to swing, the actuator is configured to disengage the latch mechanism from the striker. The lock sensor portion is configured to detect a change in an electrostatic capacity.

According to the first aspect, the vehicular door is provided with the door handle and the latch mechanism. The door handle is provided in the door panel that configures a part of the vehicular door. When the vehicular door is in the closed state, the latch mechanism is configured to maintain the closed state of the vehicular door by being engaged with the striker provided on the vehicle body. The door handle is provided with the unlatch portion, and the unlatch portion is configured to be at least partially exposed to the outside and swing with respect to the door handle. As the unlatch portion swings, the actuator of the electric unlatch operation mechanism activates to disengage the latch mechanism from the striker. Further, the lock sensor portion is provided in the part of the unlatch portion, the part being exposed to the outside of the door handle. The lock sensor portion is configured to detect a change in the electrostatic capacity. Therefore, the lock sensor portion is arranged so as to become close to a finger of a user when the user grips the door handle and operates the unlatch portion. Therefore, a change in the electrostatic capacity is detected more reliably.

According to the first aspect, it is possible to restrain deterioration of detection performance of a sensor provided inside the door handle.

In the first aspect, the lock sensor portion may be attached to the unlatch portion at a position inward of the unlatch portion in the door handle.

With the foregoing configuration, since the lock sensor portion may be attached to the unlatch portion at the position inward of the unlatch portion in the door handle, the lock sensor portion is not exposed to the outside. Therefore, it is possible to restrain malfunction of the lock sensor portion caused by foreign matters being adhered to the lock sensor portion.

With the foregoing configuration, it is possible to even more reliably restrain deterioration of detection performance of the sensor provided inside of the door handle.

In the first aspect, the lock sensor portion may be provided through the door handle and the unlatch portion, and a bent portion may be provided in the lock sensor portion between the door handle and the unlatch portion. The bent portion serves as a fulcrum of swinging of the unlatch portion.

With the foregoing configuration, the bent portion may be provided in the lock sensor portion between the door handle and the unlatch portion, the lock sensor portion being provided through the door handle and the unlatch portion. Because the bent portion serves as the fulcrum of swinging of the unlatch portion, the lock sensor portion also functions as an energizing member for the unlatch portion that swings. Therefore, it is possible to reduce the number of components.

With the foregoing configuration, it is possible to reduce cost.

In the first aspect, the lock sensor portion may have a plate shape portion in which a swinging direction of the unlatch portion is a thickness direction of the lock sensor portion, and the bent portion may have a U-shaped portion that is open in the thickness direction.

In the first aspect, the lock sensor portion may have a plate shape portion in which a vehicle width direction is a thickness direction of the lock sensor portion, and the bent portion may have a U-shaped portion that is open in the thickness direction.

With the foregoing configuration, the lock sensor portion may have the plate shape portion in which the vehicle width direction is the thickness direction of the lock sensor portion. Also, the bent portion may have the U-shaped portion that is open in the thickness direction. Therefore, when the unlatch portion swings, stress acting on the bent portion is not concentrated on one point, and can be scattered throughout the entire portion of the U-shape. Thus, it is possible to reduce damages on the component caused by concentration of stress With the foregoing configuration, it is possible to improve durability.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
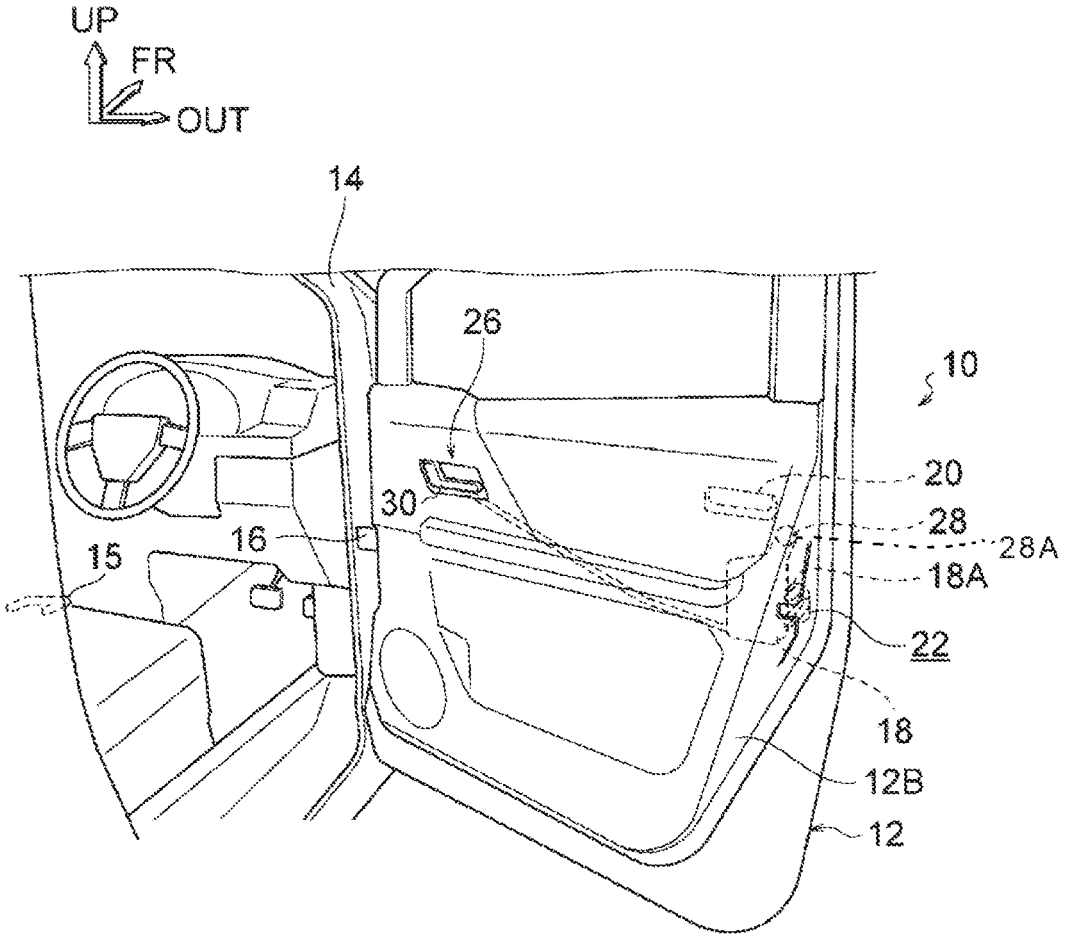
FIG. 1 a schematic perspective view of a vehicular door having a vehicular door structure according to an embodiment, the vehicular door being in an open state and seen from a vehicle rear side.

With reference to FIG. 1 to FIG. 4, an embodiment of a vehicular door structure according to the disclosure is described. In the drawings, an arrow FR represents a front side in a vehicle front-rear direction, an arrow OUT represents an outer side in a vehicle width direction, and an arrow UP represents an upper side in a vehicle upper-lower direction.

Overall Configuration

As shown in FIG. 1, a vehicular door 12 having a vehicular door structure 10 is attached to a vehicle body 14 through a hinge 16 so that the vehicular door 12 is able to open and close. The vehicular door 12 includes a latch mechanism 18 and a door handle 20. The vehicular doors 12 are provided on the right and the left in a vehicle width direction, respectively, as a pair, and they are symmetric. Therefore, in the description below, only the vehicular door 12 on a vehicle right side is described.

Latch Mechanism

The latch mechanism 18 is arranged in a region defined by a door outer panel 12A (see FIG. 2) and a door inner panel 12B, and at a position corresponding to a striker opening portion 22 described later. The door outer panel 12A serves as a door panel and is provided on an outer side of the vehicular door 12 in the vehicle width direction, and the door inner panel 12B is provided on an inner side in the vehicle width direction. The striker opening portion 22 is provided in an end portion of the vehicular door 12 on a vehicle rear side.

The striker opening portion 22 is formed in an end portion of the door inner panel 12B on the vehicle rear side. The striker opening portion 22 is formed at a position corresponding to a striker 15 provided in the vehicle body 14, and is formed into a shape such that the striker 15 can be inserted inside the door inner panel 12B when the vehicular door 12 is in a closed state.

The latch mechanism 18 includes a latch 18A, a mechanical unlatch operation mechanism 26, and an electric unlatch operation mechanism 28 inside a unit case. The latch 18A is formed into an almost U-shape having a striker insertion groove inside when seen from the vehicle rear side. At the same time, the latch 18A is held on a vehicle upper side of a latch holding bracket (not shown) by a fastening tool. The latch holding bracket is provided on a vehicle front side with respect to the latch 18A. Thus, the latch 18A is able to turn about a longitudinal direction of the vehicular door 12, the longitudinal direction serving as an axis direction. The latch 18A is energized by a spring (not shown) so that an opening of the striker insertion groove faces an inner side in the vehicle width direction. The state in which the opening of the striker insertion groove of the latch 18A facing the inner side of the vehicle width direction is referred to as an "unlatched state".

When the vehicular door 12 is closed while the latch 18A is in the unlatched state, the striker is inserted inside the striker insertion groove of the latch 18A, and the latch 18A is turned so that the opening of the striker insertion groove faces the outer side in the vehicle width direction. In this state, a latch engagement pawl is engaged with a latch holder (not shown) formed on a side surface of the latch 18A. Thus, turning of the latch 18A is limited and the vehicular door 12 is maintained in the closed state. This state is referred to as a "latched state". Configurations of the above-mentioned latch 18A and the latch engagement pawl are disclosed in, for example, Japanese Unexamined Patent Application Publication No. 2002-295096 (JP 2002-295096 A) and so on, and detailed description is therefore omitted.

For example, the mechanical unlatch operation mechanism includes an inside lever 30 and so on, and, as the inside lever 30 is operated, the latch engagement pawl engaged with the latch 18A is turned into an unengaged state. This means that the latch 18A is changed from the latched state to the unlatched state. Since the mechanical unlatch operation mechanism is similar to a general vehicular door lock device, detailed description thereof is omitted.

The electric unlatch operation mechanism 28 has an actuator 28A. The actuator 28A allows the pawl to turn with the use of a gear (not shown). Therefore, when the actuator 28A is activated, the latch engagement pawl engaged with the latch 18A is changed into the unengaged state. This means that the latch 18A is changed from the latched state to the unlatched state. The actuator 28A is electrically connected with a controller that includes a central processing unit (CPU), and can be activated through an operation of an opening-closing switch and so on (not shown) connected with the controller. The electric unlatch operation mechanism 28 is disclosed in, for example, JP 2002-295096 A, and detailed description thereof is therefore omitted.

Door Handle

Figure 2:
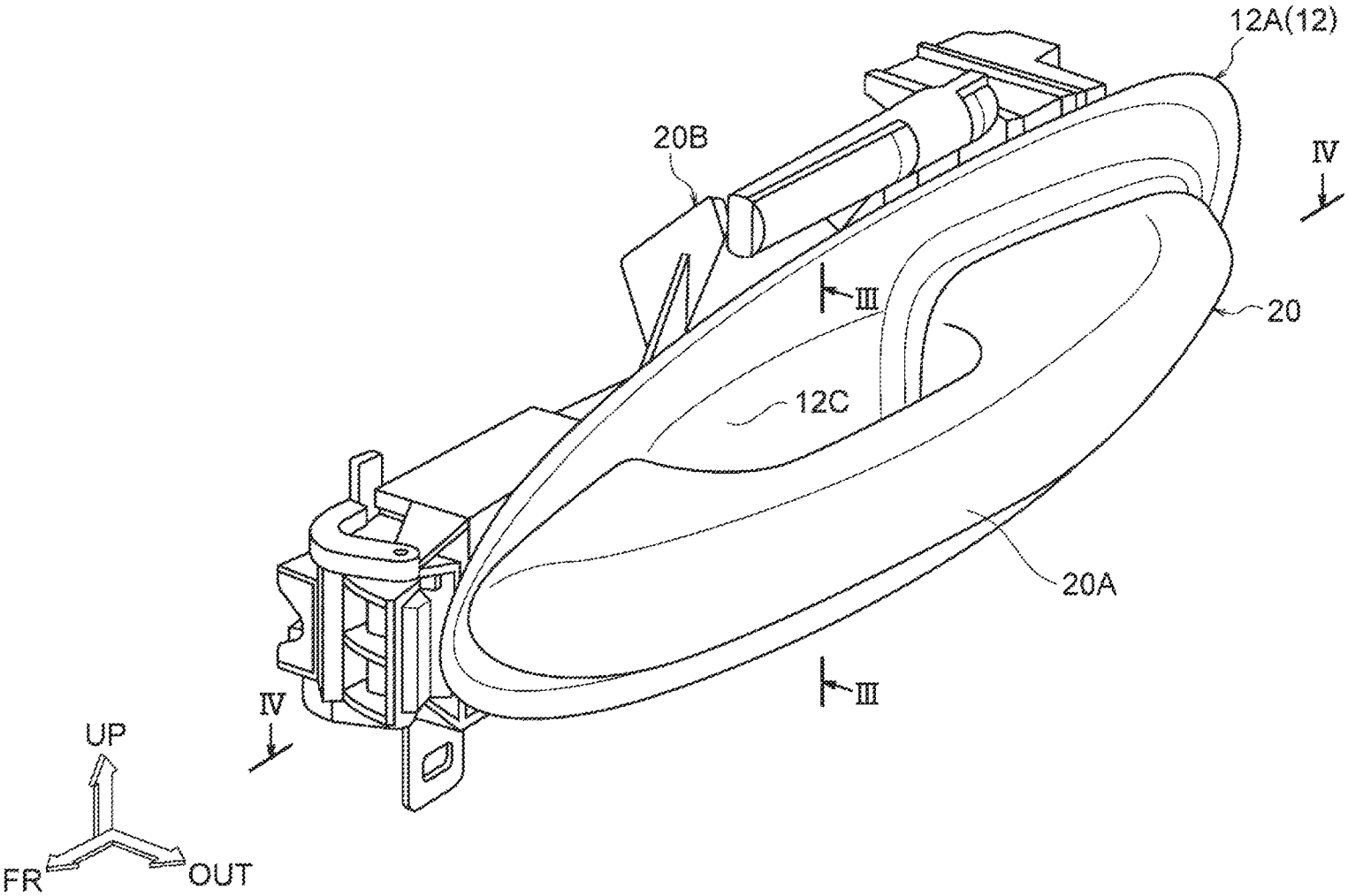
FIG. 2 is a side view of a door handle having the vehicular door structure according to the embodiment, the door handle being seen from an outer side in a vehicle width direction.
Figure 3:
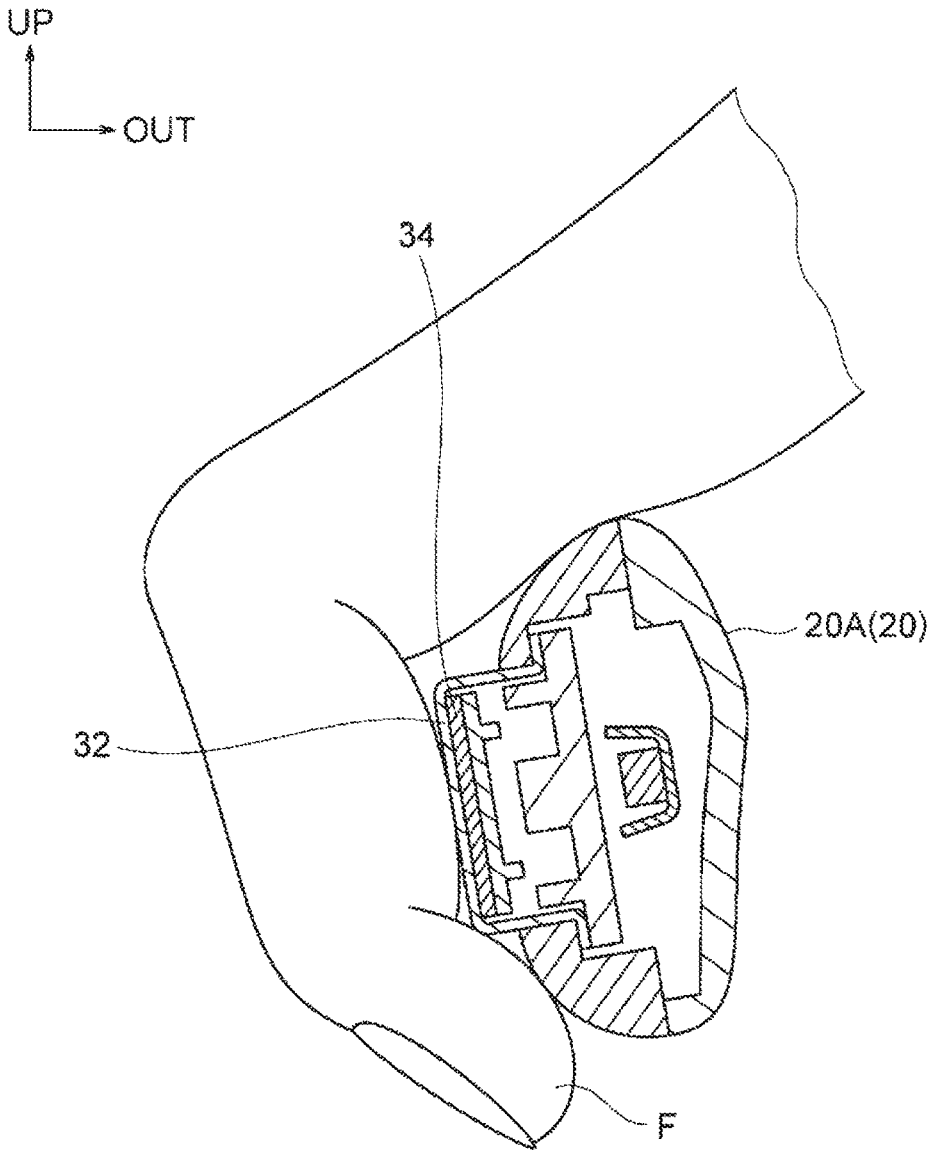
FIG. 3 is an enlarged portional view taken along the line III-III in FIG. 2.

As shown in FIG. 2, the door handle 20 is attached to the door outer panel 12A so that the door handle 20 protrudes to the outer side in the vehicle width direction. The door outer panel 12A configures the outer side of the vehicular door 12 in the vehicle width direction. The door outer panel 12A configures a design surface of the vehicle door and is made from a metallic plate material (for example, a steel plate). In a part of the door outer panel 12A corresponding to the door handle 20, a handle bowl portion 12C is formed, the handle bowl portion 12C being depressed to the inner side of the door handle. In FIG. 2, in order to simplify the configuration, the door outer panel 12A is not shown except the handle bowl portion 12C.

The door handle 20 includes a door handle grip 20A and a door handle frame 20B. The door handle grip 20A extends along the vehicle front-rear direction on the outer side of the handle bowl portion 12C of the door outer panel 12A in the vehicle width direction, and one end portion and the other end portion of the door handle grip 20A in the longitudinal direction are provided on the inner side with respect to a center portion in the vehicle width direction. This means that the door handle grip 20A is formed into an almost U-shape in a vehicle plan view, and a user is able to grip the center portion of the door handle grip 20A (see FIG. 2).

Figure 4:
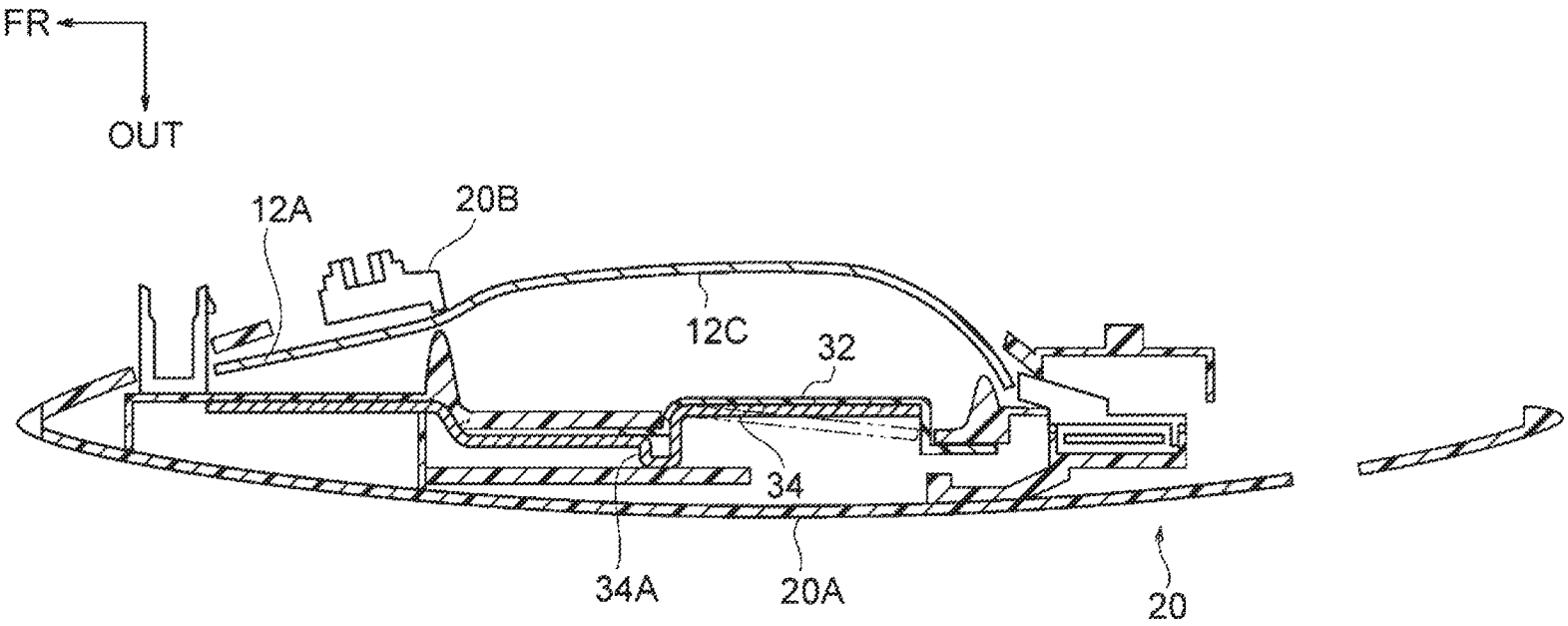
FIG. 4 is an enlarged portional view taken along the line IV-IV in FIG. 2.

As shown in FIG. 4, an unlatch lever 32 serving as an unlatch portion is provided on an inner side surface of the door handle grip 20A in the vehicle width direction. For example, the unlatch lever 32 is made of a long member having a hat-shaped portion, the long member being made from resin and extending in an almost vehicle front-rear direction (see FIG. 3). Further, a part of the unlatch lever 32 is exposed on the inner side surface of the door handle grip 20A in the vehicle with direction, and is able to swing in the vehicle width direction about a bent portion 34A described later (see a two-dot chain line in the drawing). The unlatch lever 32 is provided with the foregoing opening-closing switch (not shown), and, once the unlatch lever 32 is pushed towards the outer side in the vehicle width direction (a side of an inside of the door handle grip 20A), the opening-closing switch activates the electric unlatch operation mechanism 28.

A lock sensor plate 34 serving as a lock sensor portion is provided in an inside of the unlatch lever 32, that is a side surface of the unlatch lever 32 on the side of the door handle 20. For example, the lock sensor plate 34 is made from a metallic rectangular plate material in which a thickness direction is the vehicle width direction. The lock sensor plate 34 is provided throughout the unlatch lever 32 and the door handle grip 20A. A longitudinal direction of the lock sensor plate 34 is the vehicle front-rear direction. An electrode (not shown) is provided in the lock sensor plate 34, and electrostatic capacity measuring sensor (not shown) that measures an electrostatic capacity is connected with the electrode. Therefore, it is possible to detect changes in the electrostatic capacity of the lock sensor plate 34 caused by a finger F (see FIG. 3) of a user being closer to the lock sensor plate 34.

The bent portion 34A is formed in a part of the lock sensor plate 34 between the door handle grip 20A and the unlatch lever 32. The bent portion 34A is formed so as to have an almost U-shaped portion that is open towards the inner side in the vehicle width direction in a vehicle plan view. A part of the lock sensor plate 34 corresponding to the unlatch lever 32 is able to swing along an almost vehicle width direction about the bent portion 34A.

The door handle frame 20B is attached to the inner side of the door outer panel 12A in the vehicle width direction and extends along the vehicle front-rear direction. The door handle frame 20B holds the door handle grip 20A through a first opening portion (not shown) and a second opening portion (not shown). The first opening portion is provided in the handle bowl portion 12C of the door outer panel 12A on the vehicle front side, and penetrates the door outer panel 12A in a thickness direction. The second opening portion is provided in the handle bowl portion 12C on the vehicle rear side and penetrates the door outer panel 12A in the thickness direction.

Actions and Effects

Actions and effects of the embodiment are described next.

In this embodiment, as shown in FIG. 1, the vehicular door 12 is provided with the door handle 20 and the latch mechanism 18. The door handle 20 is provided so as to protrude to the outer side in the vehicle width direction with respect to the door outer panel 12A that configures a part of the vehicular door 12. When the vehicular door 12 is in the closed state, the latch mechanism 18 maintains the closed state of the vehicular door 12 by being engaged with the striker 15 provided on the vehicle body side. The door handle 20 is provided with the unlatch lever 32, and the unlatch lever 32 is at least partially exposed to the outside and is able to swing with respect to the door handle 20. As the unlatch lever 32 swings, the actuator 28A of the electric unlatch operation mechanism 28 is activated so as to disengage the latch mechanism 18 from the striker 15. Also, the lock sensor plate 34 is provided in the part of the unlatch lever 32, the part being exposed at least to the outside of the door handle 20. The lock sensor plate 34 detects changes in the electrostatic capacity. Therefore, since the lock sensor plate 34 is arranged near a finger F of a user (see FIG. 3) when the user grips the door handle 20 and operates the unlatch lever 32, a change in the electrostatic capacity is detected more reliably. Thus, it is possible to restrain deterioration of detection performance of a sensor provided inside the door handle 20.

Further, since the lock sensor plate 34 is attached to the unlatch lever 32 on the side of the inside of the door handle 20, the lock sensor plate 34 is not exposed to outside. Therefore, it is possible to restrain malfunction of the lock sensor plate 34 caused by foreign substances being adhered to the lock sensor plate 34. Thus, it is possible to further restrain deterioration of detection performance of a sensor provided inside the door handle 20.

Moreover, the bent portion 34A is provided in the part of the lock sensor plate 34 between the door handle 20 and the unlatch lever 32, the lock sensor plate 34 being provided throughout the door handle 20 and the unlatch lever 32. Since the bent portion 34A serves as a fulcrum of swinging of the unlatch lever 32, the lock sensor plate 34 also has a function as an energizing member of the unlatch lever 32 that swings. Therefore, it is possible to reduce the number of components. Thus, cost is decreased.

Furthermore, the lock sensor plate 34 is formed so as to have a plate shape, the thickness direction of which is the swinging direction of the unlatch lever 32. At the same time, a portional shape of the bent portion 34A is formed into the almost U-shape that is open in the thickness direction. Therefore, when the unlatch lever 32 swings, stress acting on the bent portion 34A is not concentrated on one point, and can be dispersed across the entire portion formed into the almost U-shape. This means that a damage of a component caused by concentration of stress can be reduced. Thus, it is possible to improve durability.

In the foregoing embodiment, the bent portion 34A of the lock sensor plate 34 is formed into the almost U-shape that is open to the inner side in the vehicle width direction. However, the disclosure is not limited to this, and the bent portion 34A may be formed into an almost U-shape that is open to the outer side in the vehicle width direction, or may be formed into other shapes than that. Further, the bent portion 34A may be omitted.

Moreover, the unlatch lever 32 is formed into a long, so-called lever-shape. However, the disclosure is not limited to this, and the unlatch lever 32 may be formed into a button shape or other shapes.

Further, the lock sensor plate 34 is attached to the unlatch lever 32 on the inner side of the door handle 20. However, the disclosure is not limited to this, and the lock sensor plate 34 may be attached to an outer side surface of the unlatch lever 32 with respect to the door handle 20.

The embodiment of the disclosure has been described so far. However, the disclosure is not limited to the foregoing, and may be modified in a various forms and carried out without departing from the gist of the disclosure.

What is claimed is:

1. A vehicular door structure comprising:

a door handle provided in a door panel that configures a part of a vehicular door;

a latch mechanism that is provided in the vehicular door and is configured to maintain a closed state of the vehicular door by being engaged with a striker provided on a vehicle body when the vehicular door is in the closed state;

an unlatch portion that is provided in the door handle, the unlatch portion having an interior surface and an opposite exterior surface that is configured to be at least partially exposed to an outside, and the unlatch portion is configured swing with respect to the door handle;

an electric unlatch operation mechanism having an actuator that is configured to disengage the latch mechanism from the striker as the unlatch portion is made to swing; and a lock sensor portion having a first portion, a second portion, and a bent portion positioned between the first portion and the second portion, the first being provided within the door handle and extending in a vehicle front-rear direction from the bent portion towards a first end of the door handle, the second portion contacting the interior surface of the unlatched portion and extending in the vehicle front-rear direction from the bent portion towards a second end of the door handle, the second end of the door handle being opposite of the first end of the door handle, the bent portion having a U-shaped portion that is open towards the door panel, and the lock sensor portion being configured to detect a change in an electrostatic capacity.

2. The vehicular door structure according to claim 1, wherein the second portion of the lock sensor portion is attached to the interior surface of the unlatch portion.

3. The vehicular door structure according to claim 1, wherein:

the lock sensor portion is provided through the door handle and the unlatch portion; and the bent portion is provided in the lock sensor portion between the door handle and the unlatch portion, the bent portion serving as a fulcrum of swinging of the unlatch portion.

4. The vehicular door structure according to claim 3, wherein:

the lock sensor portion has a plate shape portion in which a swinging direction of the unlatch portion is a thickness direction of the lock sensor portion.

5. The vehicular door structure according to claim 3, wherein:

the lock sensor portion has a plate shape portion in which a vehicle width direction is a thickness direction of the lock sensor portion.

6. The vehicular door structure according to claim 1, wherein:

the first portion has a first end and an opposite second end, the first end of the first portion being positioned closer to the first end of the door handle than the second end of the first portion, the second end of the first portion positioned closer to the second end of the door handle than the first second of the first portion;

the second portion has a first end and an opposite second end, the first end of the second portion being positioned closer to the first end of the door handle than the second end of the second portion, the second end of the second portion positioned closer to the second end of the door handle than the first second of the second portion; and the bent portion having a first wall, a second wall, and an intermediate wall extending between the first wall and the second wall, the first wall, the second wall, and the intermediate wall defining the U-shaped portion, the second end of the first portion being coupled to the first wall of the bent portion, and the first end of the second portion being coupled to the second wall of the bent portion.

* * * * *